US006616318B1

(12) United States Patent
LeBlanc et al.

(10) Patent No.: US 6,616,318 B1
(45) Date of Patent: Sep. 9, 2003

(54) MIXING APPARATUS WITH AN UPPER MIXING ELEMENT ROTATABLY AND RECIPROCATABLY ASSOCIATED WITH A BASE MIXING ELEMENT

(76) Inventors: Jesse M. LeBlanc, 248 Old Spanish Trail, Gibson, LA (US) 70356; Ajay M. Pathak, 176 Oakley Rd., Belmont, MA (US) 02478

( * ) Notice: Subject to any disclaimer, the term of this patent is extended or adjusted under 35 U.S.C. 154(b) by 0 days.

(21) Appl. No.: 09/877,468

(22) Filed: Jun. 8, 2001

(51) Int. Cl.[7] ..... B01F 7/18; B01F 7/26

(52) U.S. Cl. ..... 366/129; 366/286; 366/289; 366/295; 366/316; 366/317; 366/328.2

(58) Field of Search ..... 366/328.2, 129, 366/130, 286, 289, 293–296, 331, 349, 316, 317; 248/154

(56) References Cited

U.S. PATENT DOCUMENTS

| | | | | |
|---|---|---|---|---|
| 623,668 | A | | 4/1899 | Holt, Jr. |
| 861,603 | A | * | 7/1907 | Newton |
| 1,090,567 | A | * | 3/1914 | Roberts |
| 1,458,282 | A | * | 6/1923 | Fairbanks |
| 3,166,303 | A | | 1/1965 | Chapman |
| 3,170,638 | A | | 2/1965 | Burton |
| 3,455,540 | A | * | 7/1969 | Marcmann |
| 3,580,550 | A | | 5/1971 | Hunnicutt |
| 4,054,272 | A | | 10/1977 | Cooke |
| 4,197,019 | A | | 4/1980 | Schold |
| 4,254,699 | A | | 3/1981 | Skinner et al. |
| 4,260,267 | A | | 4/1981 | Walton |
| 4,329,069 | A | | 5/1982 | Graham |
| 4,428,680 | A | | 1/1984 | Persson et al. |
| 4,472,063 | A | | 9/1984 | Eickelmann |
| 4,506,989 | A | * | 3/1985 | Reh |
| 4,813,787 | A | * | 3/1989 | Conn |
| 4,893,941 | A | | 1/1990 | Wayte |
| 4,948,262 | A | | 8/1990 | Tome, Jr. |
| D316,100 | S | | 4/1991 | Kief |
| 5,073,033 | A | | 12/1991 | Klepeis |
| 5,090,816 | A | | 2/1992 | Socha |
| 5,163,648 | A | * | 11/1992 | Schneider |

* cited by examiner

*Primary Examiner*—Charles E. Cooley
(74) *Attorney, Agent, or Firm*—O'Connell Law Firm

(57) ABSTRACT

A mixing apparatus for mixing material in a container comprising a base mixing element and an upper mixing element wherein the upper mixing element can be rotatably and reciprocatably coupled to the base mixing element. The base mixing element can be formed by an elongate member that is fixed to a base plate. The upper mixing element can be formed by an elongate member, which can comprise a cylinder, that has a plurality of mixing arms fixed thereto. An aperture can be disposed adjacent to a proximal end of the elongate cylinder of the upper mixing element for allowing material to be exhausted and cleaned from within the elongate cylinder. The mixing arms can have a plurality of apertures therein, and the base plate can have a peripheral rim for maintaining the base plate spaced from the bottom surface of the container. A plurality of angled blades can be formed in the base plate for drawing material through apertures in the base plate. A strap can be provided for restraining the container against uncontrolled movement.

18 Claims, 6 Drawing Sheets

MIXING APPARATUS WITH AN UPPER MIXING ELEMENT ROTATABLY AND RECIPROCATABLY ASSOCIATED WITH A BASE MIXING ELEMENT

FIELD OF THE INVENTION

The invention disclosed herein relates generally to mixing devices. Stated more particularly, the present patent discloses and protects a mixing apparatus incorporating a base mixing element that matingly engages an upper mixing element for enabling a rapid and efficient mixing and stirring of liquids, compounds, particulate matter, and other materials.

BACKGROUND OF THE INVENTION

One will of course be aware that mixing is required in a number of applications. Some applications, such as the mixing of a relatively small volume of readily mixable material, can be carried out quickly, easily, and effectively with a simple utensil. However, other applications can prove significantly more laborious in a plurality of ways.

For example, the proper mixing of cement where solid particulate matter must be dispersed evenly and completely in a water carrier requires significant energy exertion and appreciable amounts of time. The person carrying out the mixing operation must combine two very heavy materials while ensuring that there are no dry areas, such as in a corner of the mixing container, where the particulate matter has not been mixed with the carrier. Other mixing applications, such as the mixing of large volumes of comestibles, paints, adhesives, and still other materials, can prove similarly laborious, particularly when carried out in relatively large containers.

The prior art has disclosed a plurality of devices designed to allow the task of mixing to be accomplished more quickly, more effectively, and with less manual labor. Some mixing devices have been particularly designed for mixing cement. Other mixing devices have been specifically designed for mixing other materials, such as paints, adhesives, and foods. These prior art mixing devices have undeniably contributed usefully to the present state of the art.

Unfortunately, the mixing devices of the prior art suffer from a number of problems and deficiencies. For example, many hand-held mixing devices, such as those driven by a power drill or other rotary driving device, tend to be difficult to control during their rotation in the material to be mixed. As a result, such devices tend to wander around in the material to be mixed thereby preventing a controlled mixing process, increasing the danger of spilling and the danger to the user, and rendering a complete and effective mixing difficult or impossible.

Furthermore, many mixing devices of the prior art make it difficult for a user to ensure that all material has been mixed thereby increasing the time required for mixing and rendering it possible and even likely that some material will not be mixed fully and properly. One who has experimented with prior art mixing devices will be aware of still further deficiencies and difficulties that one must confront in attempting to complete a proper and complete mixing operation.

In light of the foregoing, it becomes clear that there is an appreciable need for a mixing device that would provide a solution to one or more of the deficiencies from which the prior art has suffered. It is still more clear that a mixing device providing a solution to each of the needs left by the prior art while providing a number of heretofore unrealized advantages thereover would represent a marked advance in the art.

SUMMARY OF THE INVENTION

Advantageously, the present invention is founded on the broadly stated object of providing a mixing apparatus that solves each of the deficiencies that the prior art has been unable to resolve while supplying a number of even further advantages thereover.

A more particular object of the invention is to provide a mixing apparatus that can carry out mixing operations in a stable and easily controlled manner.

Another object of the invention is to provide a mixing apparatus that can be used for mixing a wide variety of materials.

A further object of the invention is to provide a mixing apparatus that can consistently mix materials quickly and completely while requiring minimal effort by a user.

Still another object of the invention is to provide a mixing apparatus that can carry out a mixing operation with substantially no danger to an operator and with minimal risk of spillage.

These and further objects and advantages of the invention will be readily obvious not only to one who has reviewed the present specification and drawings but also to one who has had an opportunity to make use of an embodiment of the present invention for a mixing apparatus.

In carrying forth these objects, a most basic embodiment of the present invention for a mixing apparatus comprises a base mixing element, an upper mixing element, and a means for rotatably and reciprocatably coupling the upper mixing element to the base mixing element. Under this arrangement, the base mixing element and the upper mixing element can cooperate to mix material in the container by a rotation of the upper mixing element within the container and a reciprocation of the upper mixing element relative to the base mixing element. Advantageously, the base mixing element restrains the upper mixing element against undesirable lateral movement thereby rendering the mixing operation a smooth and controllable process.

The base mixing element can be formed by a base plate, which can be round, and an elongate member, such as a rod, that is fixed to the base plate. The upper mixing element can have a plurality of mixing arms that extend radially from an elongate member, which can comprise a cylinder. With this, the elongate cylinder of the upper mixing element can matingly receive the elongate rod of the base mixing element to rotate thereabout and reciprocate therealong.

In a further improvement, one or more apertures can be disposed adjacent to a proximal end of the elongate cylinder of the upper mixing element so that material can be exhausted and cleaned from within the elongate cylinder. Also, each of the mixing arms of the upper mixing element can have a plurality of apertures therein for allowing material to pass therethrough. Still further, the mixing apparatus can incorporate a means for maintaining the base plate of the base mixing element spaced from a bottom surface of the container. Of course, this could be accomplished in a number of ways. In one preferred embodiment, that means takes the form of a downturned rim disposed at a peripheral edge of the base plate.

The performance of the mixing apparatus can be improved still further by the incorporation of a plurality of angled blades fixed to the base plate of the base mixing element. The blades, which can be disposed at an angle of roughly 15 degrees relative to the base plate, can be formed integrally with the base plate. Also, the blades can be generally aligned with a radius of the base plate. The base plate can be formed as a round disk. Alternatively, it can be divided into a plurality of sections, and the angled blades can comprise radial edge of the sections.

One will appreciate that a portable container could have a tendency to move during a mixing operation in response to the rotary forces of the mixing apparatus as it is driven by a drill or the like. Advantageously, the present invention can further include a means for restraining the container against uncontrolled movement. In a preferred embodiment, the restraining means can be a strap with a hook at the end thereof for coupling to a bail portion of the container. With this, a user can engage the hook and step on the strap thereby preventing inadvertent movement of the container.

The foregoing discussion broadly outlines the more important features of the invention to enable a better understanding of the detailed description that follows and to instill a better appreciation of the inventors' contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

As is the case with many inventions, the present invention for a mixing apparatus is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
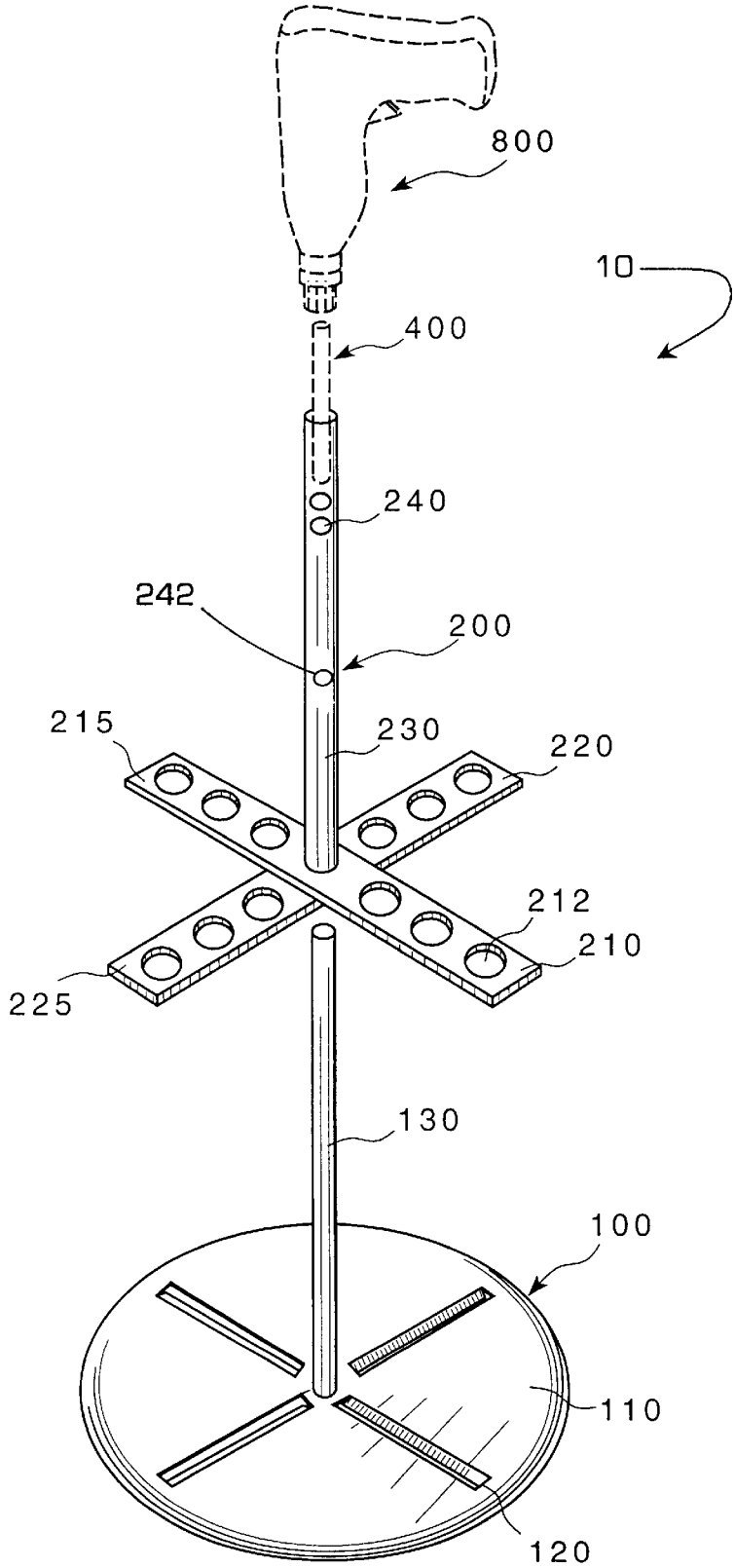
FIG. 1 is an exploded perspective view of an embodiment of the present invention for a mixing apparatus where an upper mixing element is shown slightly disassociated from a base mixing element.

Looking more particularly to the drawings, a preferred embodiment of the present invention for a mixing apparatus is indicated generally at 10 in FIG. 1. There, one sees that the mixing apparatus 10 is formed by the combination of a base mixing element 100 with an upper mixing element 200. As will be described more fully below, depending on the mixing application and the goals of the user, the base mixing element 100 and the upper mixing element 200 can be used in combination or individually.

Where the mixing elements 100 and 200 are used in combination to form the mixing apparatus 10, the upper mixing element 200 matingly engages the base mixing element 100. Under this arrangement, the upper mixing element 200 is drivably engaged with a rotary driver, such as a power drill 800. When the upper mixing element 200 and the base mixing element 100 are used individually, the respective mixing element 100 or 200 is drivably engaged with the power drill 800 for rotation thereby.

Looking more particularly to the base mixing element 100 of FIG. 1, one sees that the base mixing element 100 is founded on a circular base plate 110. An upstanding rod 130 projects from a first or upper surface of the base plate 110. The base plate 110 has a plurality of radially extending blades 120 formed therein. As is shown most clearly in FIGS. 10 and 11, the blades 120 in this embodiment are formed from integrally with the base plate 110 as by a pressing operation or the like. With this, the formation of each blade 120 leaves an aperture 124 in the base plate 110 through which material to be mixed (not shown) can pass such as when the base mixing element 100 is rotated. In a most preferred embodiment, the blades 120 will be disposed at an angle of approximately 15 degrees relative to the upper surface of the base plate 110.

Even more preferably, the base mixing element 100 will incorporate a means for maintaining the central body portion of the base plate 110 and the lower edges of the blades 120 spaced from the bottom surface of the container 500. Of course, such a means could take a number of forms. Ideally, the spacing means will maintain the lower edges of the blades 120 just slightly above or in marginal contact with the bottom surface of the container 500. In this embodiment, the spacing means is carried forth in the form of a downturned rim portion 140 that is disposed at the periphery of the base plate 110.

Figure 6:
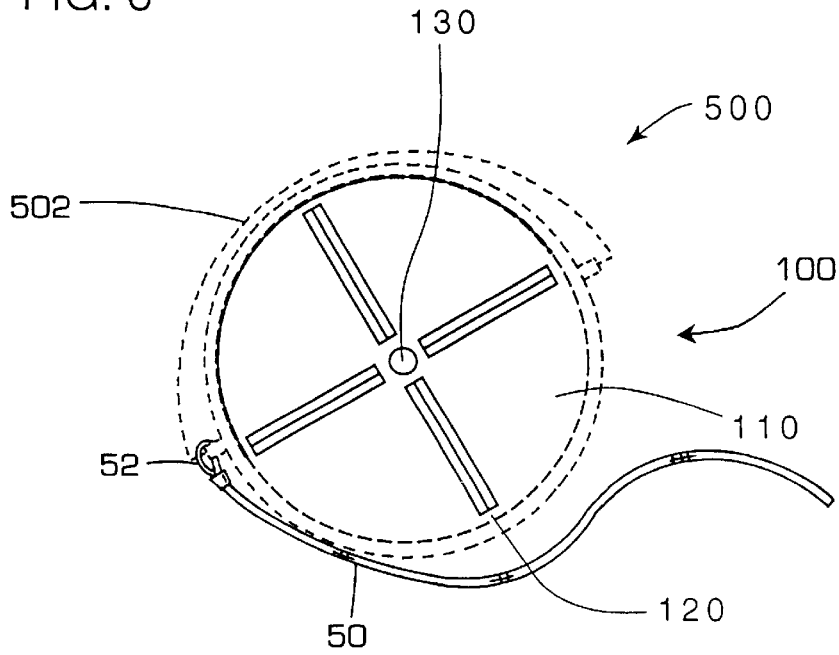
FIG. 6 is a top plan view of the base mixing element of FIG. 1 while seated in a round container.
Figure 7:
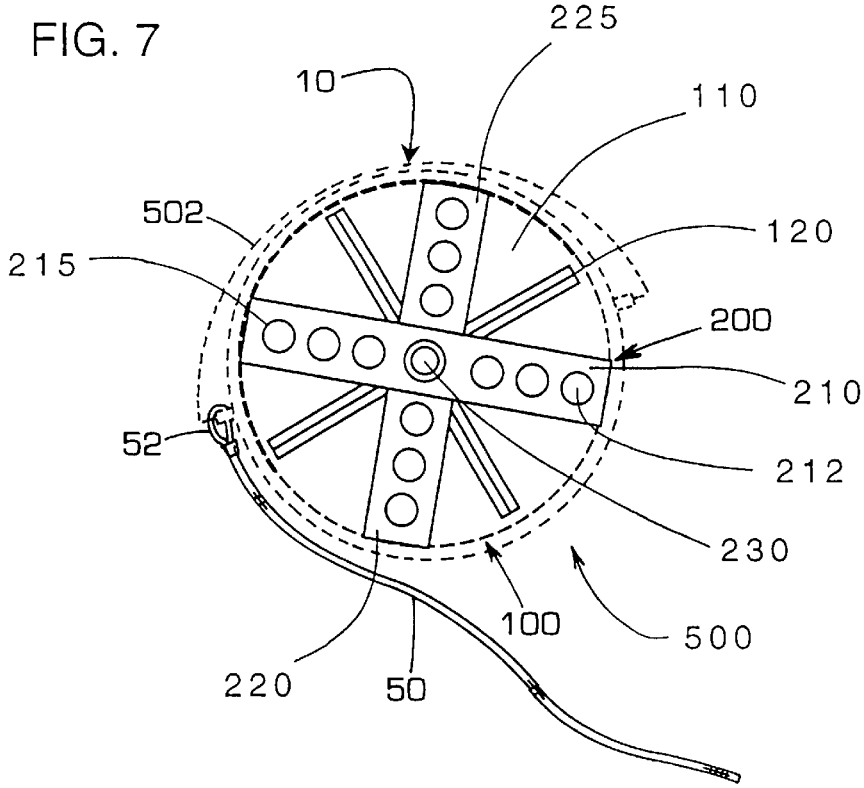
FIG. 7 is a top plan view of the upper mixing element and the base mixing element coupled to form the mixing apparatus and seated in a round container.

As will be discussed below, the invention can be used to great advantage in a round container 500 as is shown in FIGS. 6 and 7. For example, in a particularly preferred embodiment, the upper mixing element 200 and the base mixing element 100 can be crafted for optimal use in a standard five gallon bucket as is commonly used for storing and transporting a wide variety of materials. In such an embodiment, the diameter of the base plate 110 of the base mixing element 100 preferably will have a diameter just slightly less than the inner diameter of the container 500. Furthermore, the base mixing element preferably will have a height from the bottom of the base plate 110 to the tip of the rod 130 that is greater than that of the container 500 relative to which it is to be used.

Looking more particularly to the upper mixing element 200, one sees that it incorporates an axle cylinder 230 that can matingly receive the rod 130 of the base mixing element 100. The axle cylinder 230 has a proximal end and a distal end. As can be seen most clearly in FIG. 2, a bit 400 is fixedly retained in an aperture 232 in the proximal end of the axle cylinder 230 for drivably engaging the drill 800. A plurality of evenly spaced mixing arms 210, 215, 220, and 225 are fixed to the distal end of the axle cylinder 230 for rotation therewith.

In this embodiment, first and second arms 210 and 215 are formed from a single strip of material, which, for example, can be steel or a similarly strong material. With this, the first and second arms 210 and 215 are disposed in a single plane. Likewise, the second and third arms 220 and 225 are formed from a single strip of material such that they are disposed in a single plane. The mixing arms 210, 215, 220, and 225 preferably will be flat. Where metal is employed form forming the mixing arms 210, 215, 220, and 225, they can have a thickness of approximately 3/16 inch. It should be clear, of course, that additional or fewer mixing arms could be provided depending on a plurality of factors including the material to be mixed, the power of the drill 800 or other rotary driving device, and the desired mixing speed.

A plurality of apertures 212 are disposed in the mixing arms 210, 215, 220, and 225 for allowing the material to be mixed to pass therethrough. In the embodiment of FIG. 1, each mixing arm 210, 215, 220, and 225 has three round apertures 212 spaced therealong. Of course, the size, shape and number of apertures 212 can be varied depending on a number of factors including the tensile strength of the material used to make the mixing arms 210, 215, 220, and 225 and the size of the largest particle, if any, one can expect to encounter in the material to be mixed.

In an even further refinement, one or more exhaust and cleaning apertures 240 are disposed in the axle cylinder 230 adjacent to the proximal end thereof. With this, when the axle cylinder 230 of the upper mixing element 200 is slid over the rod 130 of the base mixing element 100 material trapped inside the axle cylinder 230 can be exhausted from the exhaust and cleaning apertures 240. Furthermore, the exhaust and cleaning apertures 240 can allow a more efficient cleaning of material remnants from within the axle cylinder 230. As FIG. 1 also shows, the axle cylinder 230 can additionally incorporate another exhaust and cleaning aperture 242 in a mid portion thereof for minimizing or eliminating the need for material to reach or be exhausted from the upper exhaust and cleaning apertures 240.

Figure 2:
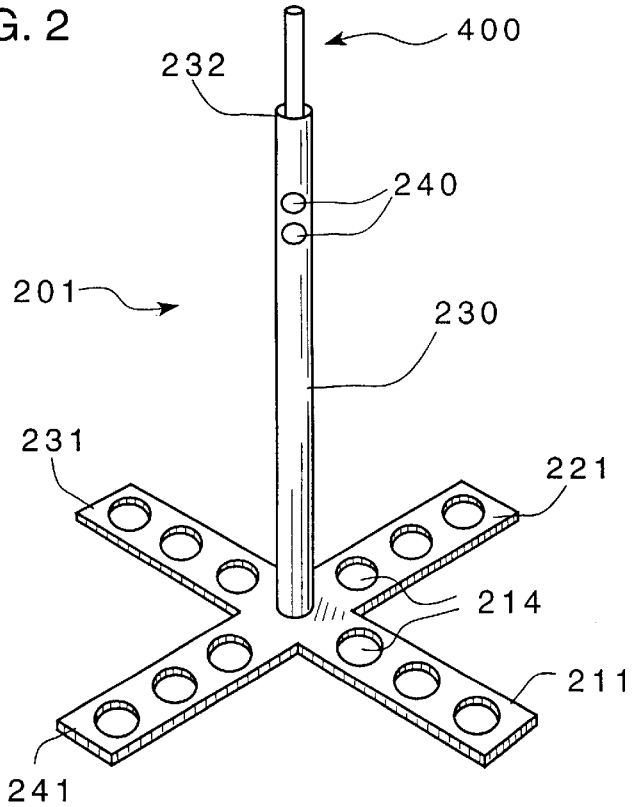
FIG. 2 is a perspective view of an alternative embodiment of the upper mixing element of the present invention.

Referring next to FIG. 2, an alternative embodiment of the upper mixing element 201 is illustrated. In this embodiment, the first, second, third, and fourth arms 211, 221, 231, and 241 are in a single plane. Although they again could be without pitch, the arms 211, 221, 231, and 241 in this embodiment can have a pitch relative to the axle cylinder 230. Each arm 211, 221, 231, and 241 has three round apertures 214. Again, a bit 400 is fixed in an aperture 232 in the proximal end of the axle cylinder 230 for enabling the upper mixing element 201 to be driven by a drill 800.

Figure 3:
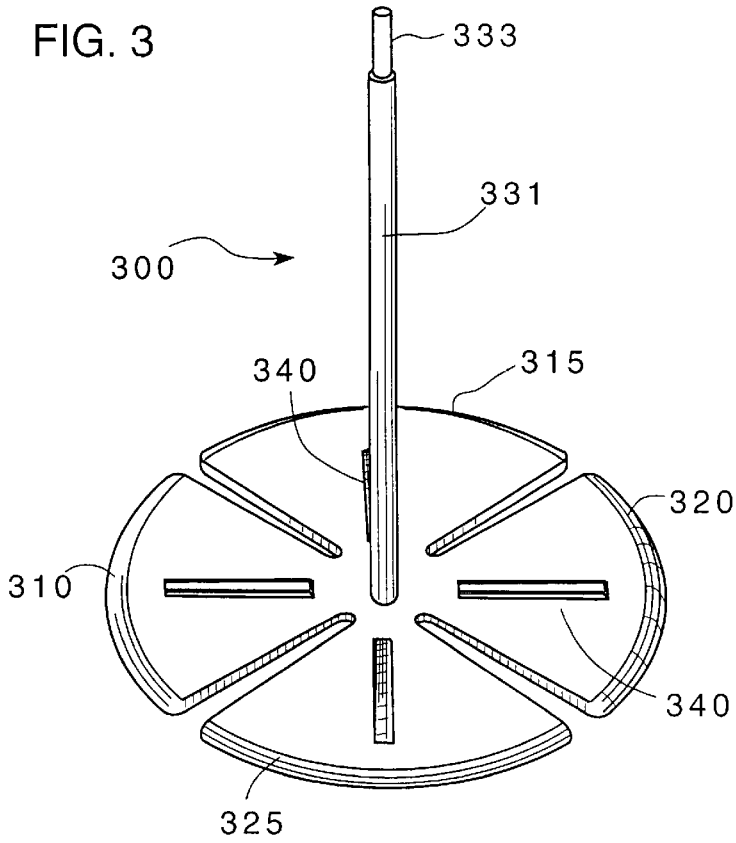
FIG. 3 is a perspective view of an alternative embodiment of the base mixing element.

Looking next to FIG. 3, one sees an alternative embodiment of the base mixing element 300. In this embodiment, the base plate is formed in four radially-divided sections 315, 320, 325, and 330. A blade 140 is formed in each of the four sections 315, 320, 325, and 330. Again, each blade 140 forms an angle of approximately 15 degrees with the upper surface of its respective section 315, 320, 325, and 325 of the base plate. Under such a construction, the radial edges of each section 315, 320, 325, and 330 can itself be downturned to form an open-ended blade. With this, the blades 140 could be eliminated or could supplement the radial edges of the sections 315, 320, 325, and 330. Of course, a rod 331 again extends from the upper surface of the base plate that is formed by the four sections 315, 320, 325, and 330. The proximal end of the rod 331 has a bit 333 fixed thereto for enabling the base mixing element 300 to be driven by a drill 800 or the like.

Figure 4:
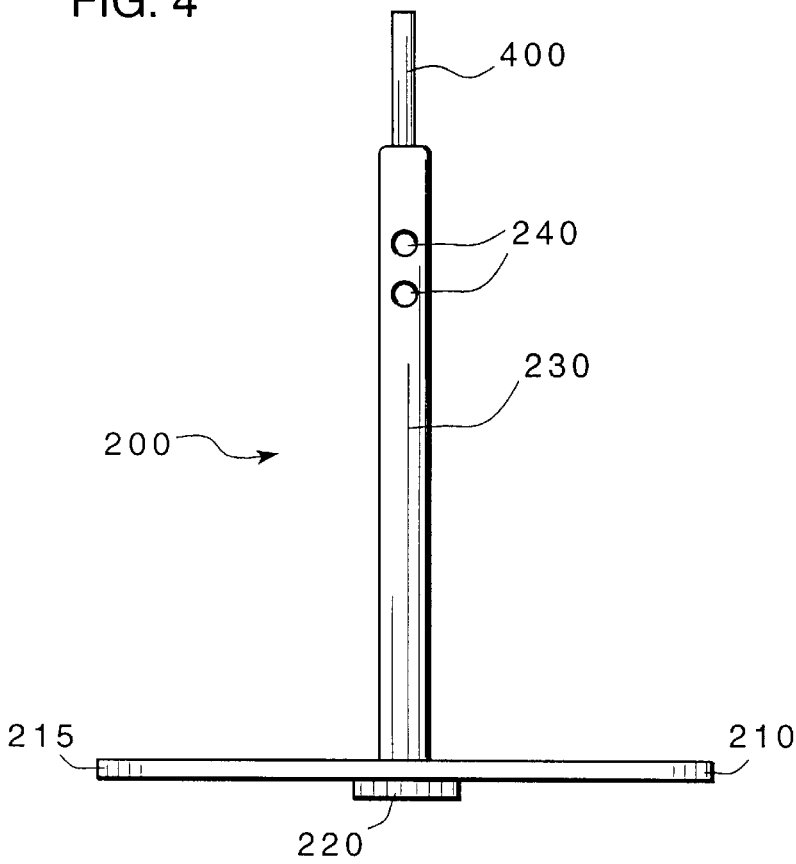
FIG. 4 is a view in side elevation of the upper mixing element of FIG. 1.

Looking next to FIG. 4, which provides view in side elevation of the upper mixing element 200 of FIG. 1, one again sees the bit 400 fixed in the proximal end of the axle cylinder 230. FIG. 1 also shows the two exhaust and cleaning apertures 240 in the axle cylinder 230, the unitary first and second arms 210 and 215, and an end portion of the third arm 220. The axle cylinder 230 extends through and is surrounded by the arms 210, 215, 220, and 225 and is open at its bottom for matingly engaging the rod 130 of the base mixing element 100. Alternatively, the axle cylinder 230 could extend slightly beyond the lower surface of the lowest of the arms 210, 215, 220, and 225, which happens to be the bottom surface of the third and fourth arms 220 and 225 in this embodiment.

Figure 5:
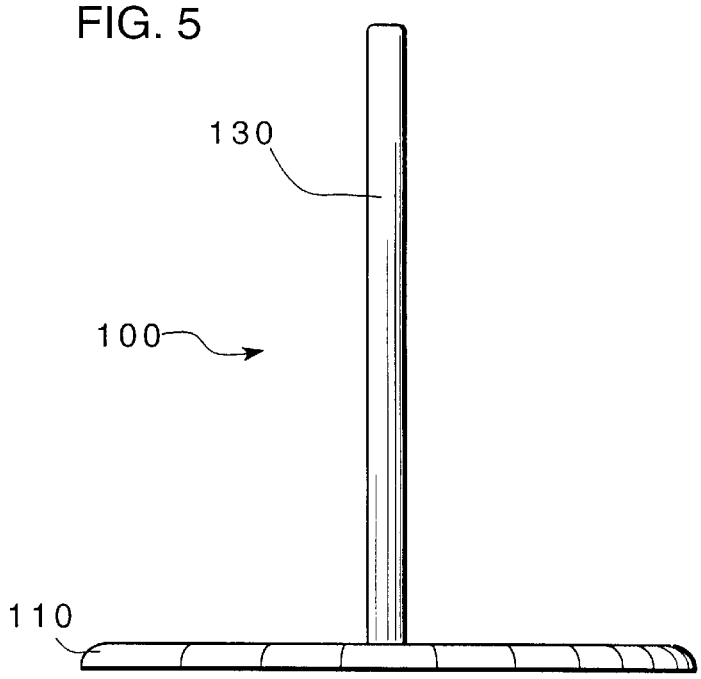
FIG. 5 is a view in side elevation of the base mixing element of FIG. 1.

FIG. 5 shows the base mixing element 100 and thus the rod 130 and the base plate 110 in side elevation while FIG. 6 provides a top plan view of the base mixing element 100 while seated in a container 500, which can comprise a standard five gallon bucket. Still further, FIG. 7 shows the upper mixing element 200 matingly engaged with the base mixing element 100 to form the mixing apparatus 10 and disposed in the container 500. The base plate 110 of the base mixing element 100 with its blades 120 is seated below the upper mixing element 200 with its arms 210, 215, 220, 225.

Each of FIGS. 6 and 7 additionally show a further refinement of the invention in the form of a means for restraining the container 500 against inadvertent rotation during rotation of the base mixing element 100 or the upper mixing element 200 by, for example, the drill 800. In this embodiment, the restraining means comprises a restraining strap 50 with a hook 52 disposed at an end thereof for coupling to an end of a bail 502 on the container 500. When the restraining strap 50 is so coupled, a user can wrap the restraining strap 50 partially around the container 500 and then step on the restraining strap 50. With this, the restraining strap 50, in combination with the user's own weight, will restrain the container 500 against the uncontrolled movement that could otherwise result in response to the rotational forces that must be imparted to the material to be mixed during a mixing operation.

Figure 8:
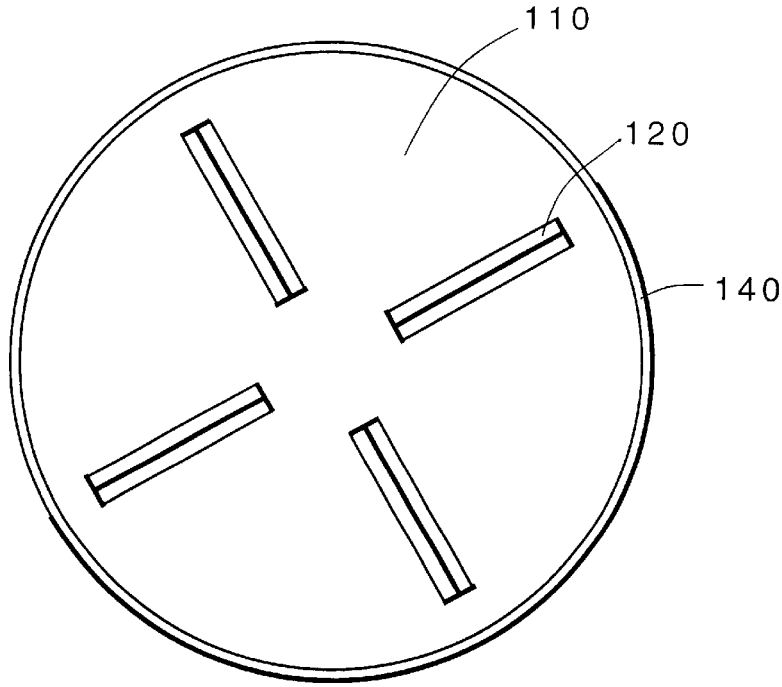
FIG. 8 is a bottom plan view of the base mixing element of FIG. 1.
Figure 9:
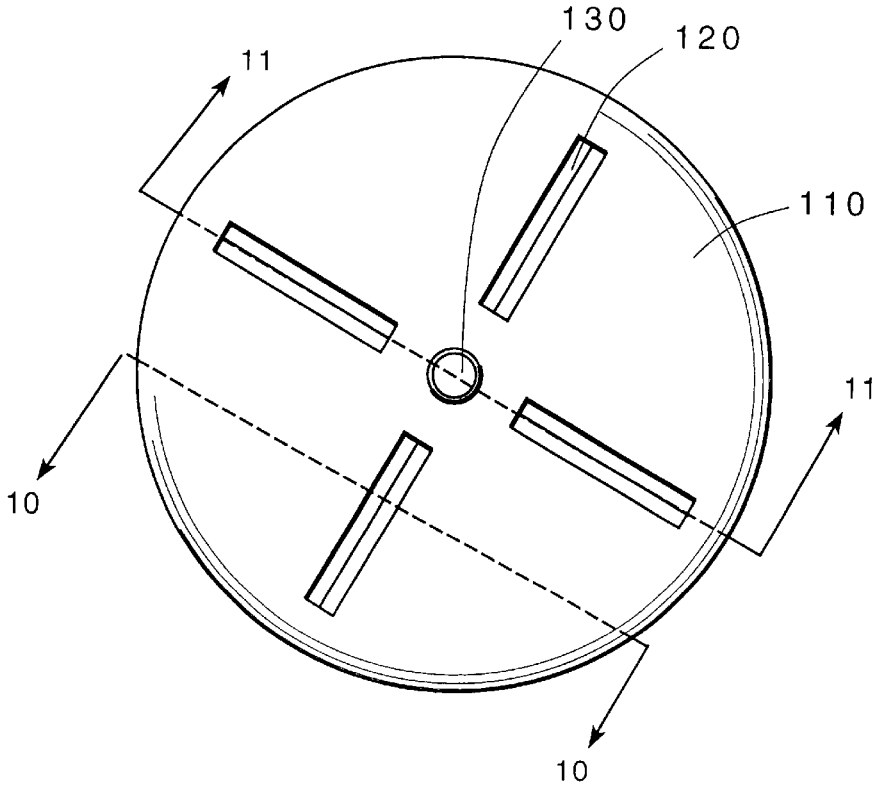
FIG. 9 is a top plan view of the base mixing element.

Turning next to FIG. 8, the base plate 110 of the base mixing element 100 is illustrated in a bottom plan view. There, one sees the downturned ridge 140 that is disposed along the circumference of the bottom side of the base plate 110. The blades 120 are also shown. In FIG. 9, the base plate 110 and the rod 130 are shown in a top plan view.

Figure 10:
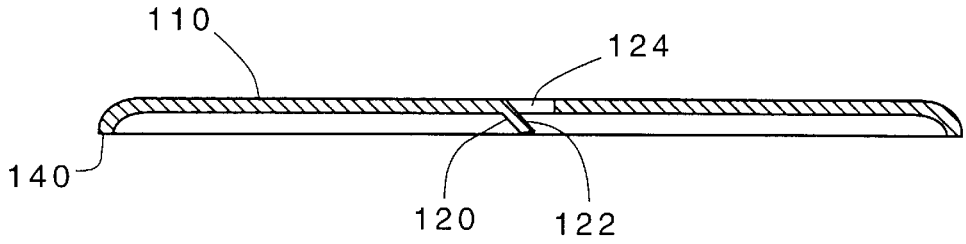
FIG. 10 is a cross-sectional view of the base mixing element taken along the line 10—10 in FIG. 9.
Figure 11:
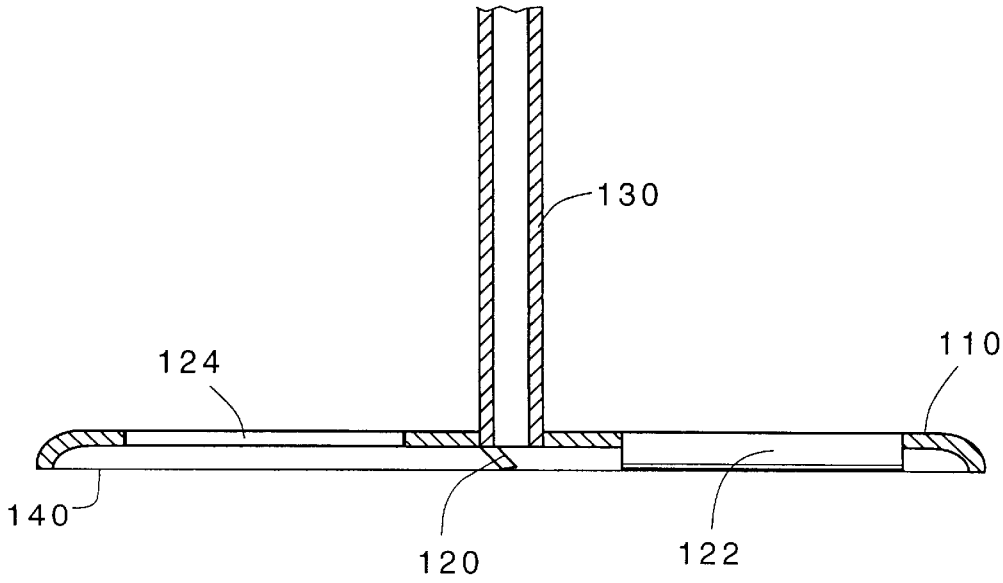
FIG. 11 is a cross-sectional view of the base mixing element taken along the line 11—11 in FIG. 9.

FIG. 10 is a cross-sectional view of the base plate 110 taken along the line 10—10 in FIG. 9. There, one sees that each blade 120 has an upper surface 122 proximal to an aperture 124 in the base plate 110. FIGS. 10 and 11 again show that the upper surface 122 of the blade 120 forms an angle of approximately 15 degrees with the surface of the base plate 110. Also, the downturned ridge 140 is again shown at the outer periphery of the base plate 110.

Under the aforedescribed arrangements, as was described previously, the base mixing element 100 and the upper mixing element 200 can be used individually or in combination to form the mixing apparatus 10. In either case, the base mixing element 100 and the upper mixing element 200 are ideally used relative to a round container 500 that has an inner diameter just slightly greater than the outer diameters of the base plate 110 and the mixing arms 210, 215, 220, and 225.

One can begin a mixing process by affixing the hook 52 of the restraining strap 50 to the bail 502 of the container 500 and then stepping on the restraining strap 50. Where the base mixing element 100 is to be used and no material is yet disposed in the container 500, one can simply place the base mixing element 100 into the container. Where the base mixing element 100 is to be used and material to be mixed is already disposed in the container 500, one can engage the drill 800 with the proximal end of the base mixing element 100 and then drive the base mixing element 100 downwardly into the material to be mixed to the base of the container 500 by using the drill 800 to rotate the base mixing element 100. As the base mixing element 100 is so rotated, the material to be mixed will pass over the blades 120 and through the apertures 124 in the base mixing element 100. The base mixing element 100 can then be raised upwardly through the material to be mixed thereby further mixing that material.

Alternatively, the drill 800 can be detached from the base mixing element 100 and coupled with the upper mixing element 200. The base mixing element 100 can then be coupled with the upper mixing element 200 by an insertion of the rod 130 into the axle cylinder 230. Then, the upper mixing element 200 can be rotatably driven by the drill 800 and then reciprocated along the rod 130 to mix the material to be mixed quickly, effectively, and completely. Advantageously, the rod 130 of the base mixing element 100 rotatably supports the upper mixing element 200 thereby allowing the upper mixing element 200 to remain centered and to rotate smoothly within the container 500.

When the material is fully mixed, a user can empty the material from the container 500 quickly and substantially completely by removing the upper mixing element 200, dumping the material from the container 500 and then, preferably while the container 500 is on its side or tilted downwardly, sliding the base mixing element 100 from within the container 500. With this, the base plate 110 of the base mixing element 100 will remove substantially all remnants of material from the container 500 as it scrapes the inner surfaces of the container 500 during its removal therefrom. Of course, one will appreciate that the upper mixing element 200 could be used without the base mixing element 100 where circumstances warrant.

In considering the aforedescribed embodiments of the invention, it will be appreciated by one skilled in the art that numerous changes and additions could be made thereto without deviating from the spirit or scope of the invention. This is particularly true when one bears in mind that the presently preferred embodiments merely exemplify the broader invention revealed herein.

Accordingly, it will be clear that those with major features of the invention in mind could craft embodiments that incorporate those major features while not incorporating all of the features included in the preferred embodiments. Therefore, the following claims are intended to define the scope of protection to be afforded the inventors. Those claims shall be deemed to include equivalent constructions insofar as they do not depart from the spirit and scope of the invention.

It must be further noted that a plurality of the following claims express certain elements as means for performing a specific function, at times without the recital of structure or material. As the law demands, these claims shall be construed to cover not only the corresponding structure and material expressly described in this specification but also equivalents thereof.

We claim as deserving the protection of Letters Patent:

1. A mixing apparatus for mixing material in a container, the mixing apparatus comprising:

a base mixing element comprising a circular base plate with at least one aperture therein and an elongate rod fixed to the base plate;

an upper mixing element comprising an elongate cylinder and at least one mixing arm fixed to the elongate cylinder;

wherein the elongate rod of the base mixing element can be matingly received into the elongate cylinder of the upper mixing element in a freely rotatable and freely reciprocatable relationship;

whereby the base mixing element and the upper mixing element can cooperate to mix material by a rotation of the upper mixing element and a reciprocation of the upper mixing element relative to the base mixing element.

2. The mixing apparatus of claim 1 further comprising at least one aperture adjacent to a proximal end of the elongate cylinder of the upper mixing element whereby the at least one aperture can be used to exhaust material from within the elongate cylinder and for cleaning material from within the elongate cylinder.

3. The mixing apparatus of claim 1 further comprising at least one aperture in a mid portion of the elongate cylinder whereby the at least one aperture in the mid portion of the elongate cylinder can be used to exhaust material from within the elongate cylinder and for cleaning material from within the elongate cylinder.

4. The mixing apparatus of claim 3 further comprising at least one aperture adjacent to the proximal end of the elongate cylinder whereby the at least one aperture adjacent to the proximal end of the elongate cylinder can be used additionally to exhaust material from within the elongate cylinder and for cleaning material from within the elongate cylinder.

5. The mixing apparatus of claim 1 wherein the upper mixing element has a plurality of mixing arms that extend radially from the elongate member of the upper mixing element.

6. The mixing apparatus of claim 1 further comprising at least one aperture in the at least one mixing arm for allowing material to pass therethrough.

7. The mixing apparatus of claim 1 further comprising a means for maintaining the base plate of the base mixing element spaced from a bottom surface of a container relative to which the mixing apparatus is employed.

8. The mixing apparatus of claim 7 wherein the means for maintaining the base plate spaced from the bottom surface of a container relative to which the mixing apparatus is employed comprises a rim disposed at a peripheral edge of the base plate.

9. The mixing apparatus of claim 1 wherein the base plate of the base mixing element is round.

10. The mixing apparatus of claim 9 further comprising a rim disposed at a peripheral edge of the base plate for maintaining the base plate spaced from a bottom surface of a container relative to which the mixing apparatus is employed.

11. The mixing apparatus of claim 1 further comprising at least one angled blade fixed to the base plate of the base mixing element.

12. The mixing apparatus of claim 11 wherein the at least one angled blade is formed integrally with the base plate of the base mixing element.

13. The mixing apparatus of claim 11 wherein the at least one angled blade is generally aligned with a radius of the base plate.

14. The mixing apparatus of claim 13 wherein the base plate is radially divided into a plurality of sections.

15. The mixing apparatus of claim 1 further comprising a means for restraining a container relative to which the mixing apparatus is employed against uncontrolled movement.

16. The mixing apparatus of claim 15 wherein the restraining means comprises a strap.

17. A mixing apparatus for mixing material in a container, the mixing apparatus comprising:

a base mixing element comprising a base plate and an elongate member fixed to the base plate wherein the base plate is radially divided into a plurality of sections;

an upper mixing element comprising at least one mixing arm and an elongate member fixed to the at least one mixing arm;

a means for rotatably and reciprocatably coupling the upper mixing element with the base mixing element comprising a means for rotatably and reciprocatably associating the elongate member of the base mixing element with the elongate member of the upper mixing element;

at least one angled blade fixed to the base plate of the base mixing element wherein the at least one angled blade is generally aligned with a radius of the base plate and wherein the at least one angled blade comprises a radial edge of at least one of the plurality of sections of the base plate;

whereby the base mixing element and the upper mixing element can cooperate to mix material by a rotation of the upper mixing element and a reciprocation of the upper mixing element relative to the base mixing element.

18. The mixing apparatus of claim 17 wherein the base plate of the base mixing element is round.

* * * * *